US012735645B2

(12) United States Patent
Thunman et al.

(10) Patent No.: US 12,735,645 B2
(45) Date of Patent: Sep. 15, 2026

(54) CONVERSION OF PLASTIC WASTE TO HYDROCARBONS USING A TRANSITION METAL OXIDE

(71) Applicant: Borealis AG, Vienna (AT)

(72) Inventors: Henrik Thunman, Gothenburg (SE); Martin Seemann, Gothenburg (SE); Chahat Mandviwala, Gothenburg (SE)

(73) Assignee: BOREALIS GMBH, Vienna (AT)

( * ) Notice: Subject to any disclaimer, the term of this patent is extended or adjusted under 35 U.S.C. 154(b) by 209 days.

(21) Appl. No.: 18/708,344

(22) PCT Filed: Nov. 9, 2022

(86) PCT No.: PCT/EP2022/081324
§ 371 (c)(1),
(2) Date: May 8, 2024

(87) PCT Pub. No.: WO2023/083887
PCT Pub. Date: May 19, 2023

(65) Prior Publication Data

US 2025/0263607 A1 Aug. 21, 2025

(30) Foreign Application Priority Data

Nov. 12, 2021 (EP) ..... 21207982

(51) Int. Cl.
*C10G 47/04* (2006.01)

(52) U.S. Cl.
CPC ..... *C10G 47/04* (2013.01); *C10G 2300/1003* (2013.01)

(58) Field of Classification Search
CPC ..... C10G 47/04; C10G 2300/1003
See application file for complete search history.

(56) References Cited

U.S. PATENT DOCUMENTS 4,851,601 A * 7/1989 Fukuda ..... C10G 1/002 208/67
5,079,385 A * 1/1992 Wu ..... C07C 4/00 585/653

(Continued)

FOREIGN PATENT DOCUMENTS

CN 1307084 A 8/2001
JP H11140460 A 5/1999

(Continued)

OTHER PUBLICATIONS

International Search Report of Application No. PCT/EP2022/081324 Dated Jan. 24, 2023.
Written Opinion of Application No. PCT/EP2022/081324.

*Primary Examiner* — Kyle Armstrong
(74) *Attorney, Agent, or Firm* — Lippes Mathias LLP

(57) ABSTRACT

A process for producing a mixture of hydrocarbons from plastic waste, the process comprising the steps of a) contacting the plastic waste with steam and a hydrogen controlling material comprising at least one transition metal and/or its oxide, wherein the transition metal is not in its highest oxidation state, thereby forming a mixture of gaseous hydrocarbons and a mixture of condensed hydrocarbons, and oxidizing the hydrogen controlling material to an oxidized hydrogen controlling material; and x) withdrawing a mixture of hydrocarbons in gaseous form.

19 Claims, 4 Drawing Sheets

Reactor setup used in the comparative and inventive examples.

(56) References Cited

U.S. PATENT DOCUMENTS

| | | | | |
|---|---|---|---|---|
| 5,841,011 | A | 11/1998 | Hashimoto et al. | |
| 6,352,674 | B2 * | 3/2002 | Matsubara | C10G 1/10 422/198 |
| 11,407,947 | B2 * | 8/2022 | Crawford | C10G 1/02 |
| 2020/0017772 | A1 | 1/2020 | Ramamurthy et al. | |
| 2022/0145194 | A1 * | 5/2022 | Nieminen | C10J 3/721 |
| 2022/0259502 | A1 * | 8/2022 | Liss | C10G 9/36 |

FOREIGN PATENT DOCUMENTS

| | | | |
|---|---|---|---|
| JP | 2001129405 | A | 5/2001 |
| JP | 2001323308 | A | 11/2001 |
| WO | 2020044375 | A1 | 3/2020 |

* cited by examiner

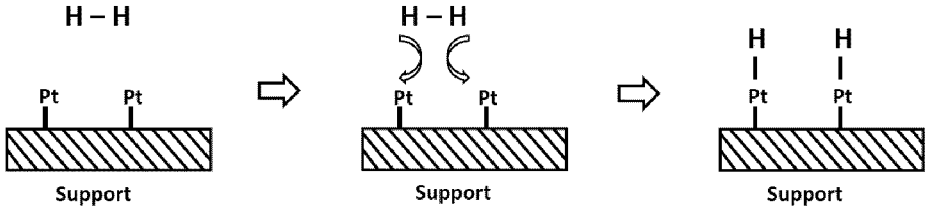
Figure 1: Hydrogen activation by hydrocracking catalysts.
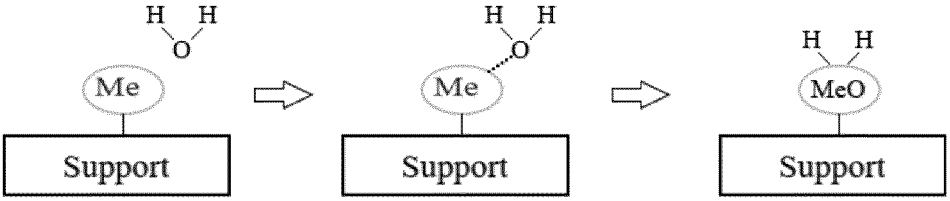
Figure 2: Hydrogen activation by a transition metal from a water molecule.
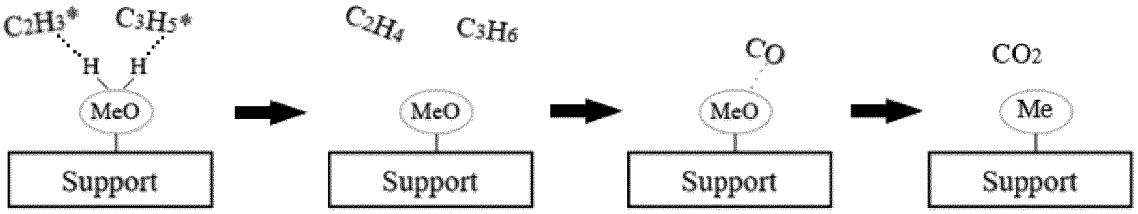
Figure 3: Hydrogenation and recycling mechanism of the hydrogen controlling material.

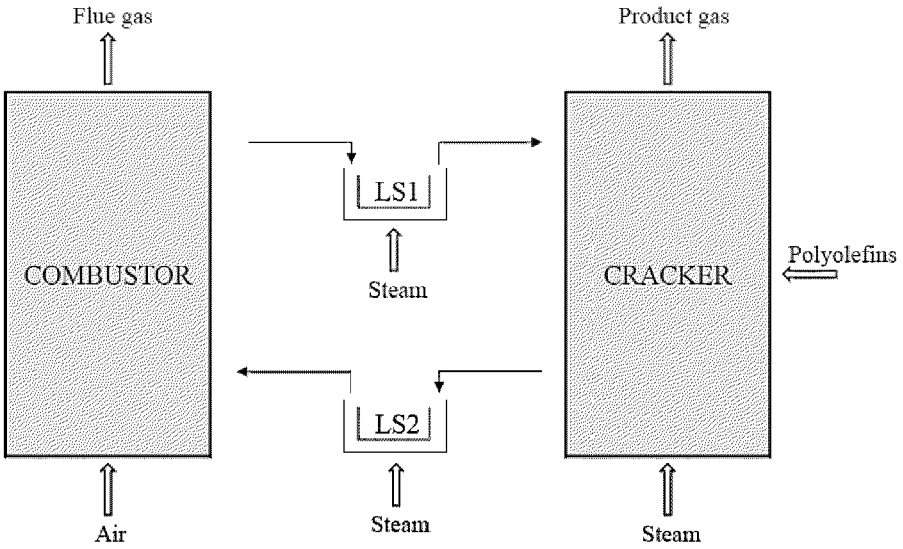
Figure 4: Configuration of a typical dual fluidized bed (DFB) system.
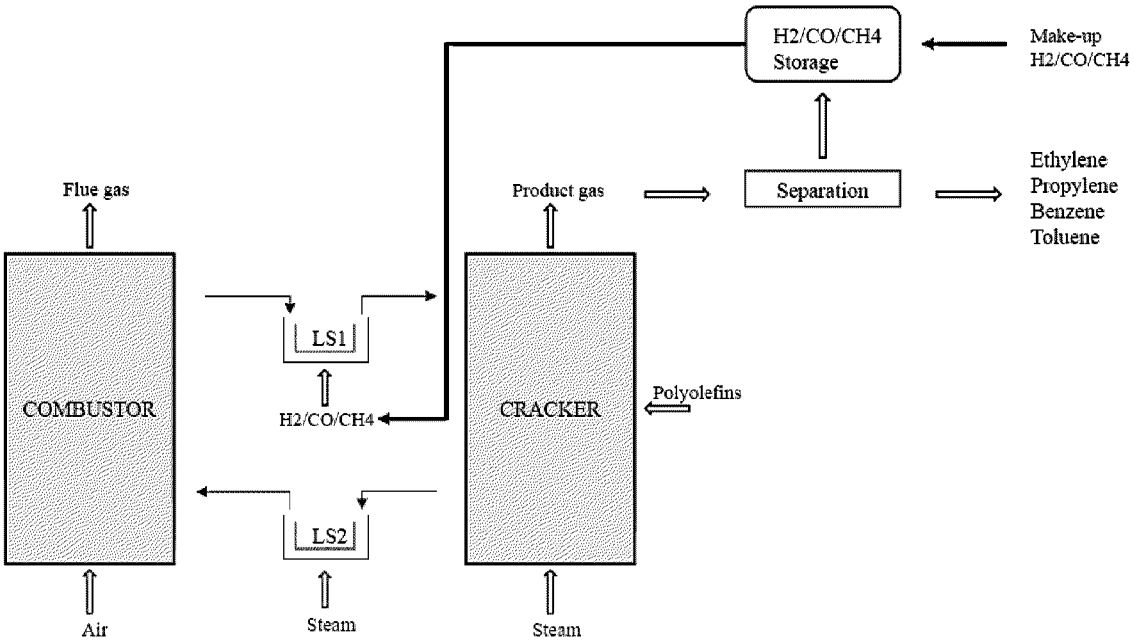
Figure 5: Dual fluidized bed configuration of the present invention.

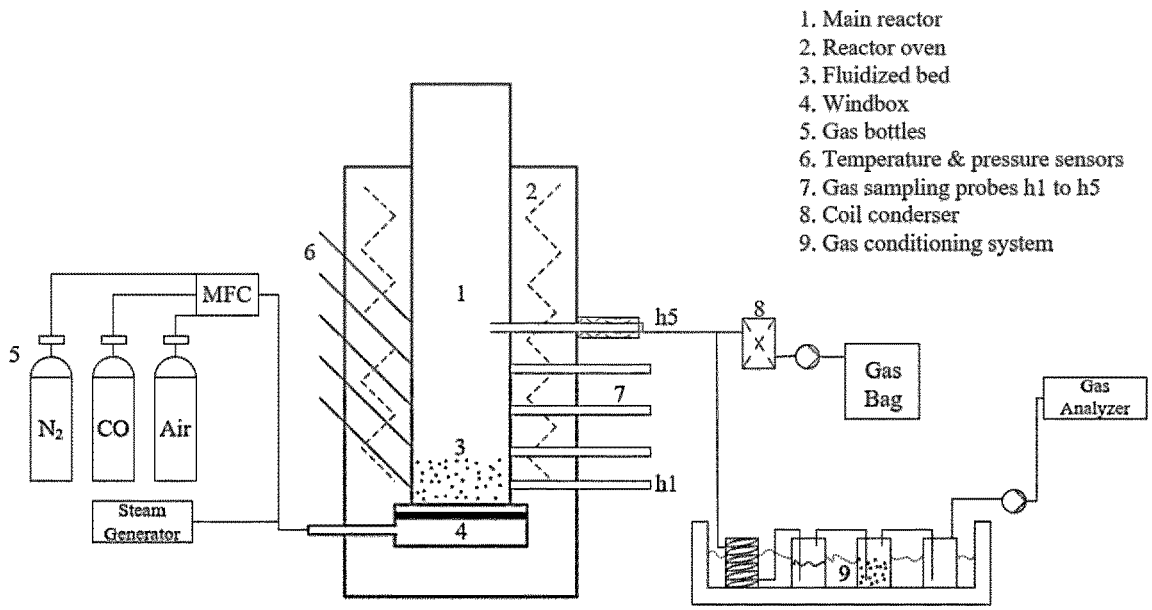
Figure 6: Reactor setup used in the comparative and inventive examples.
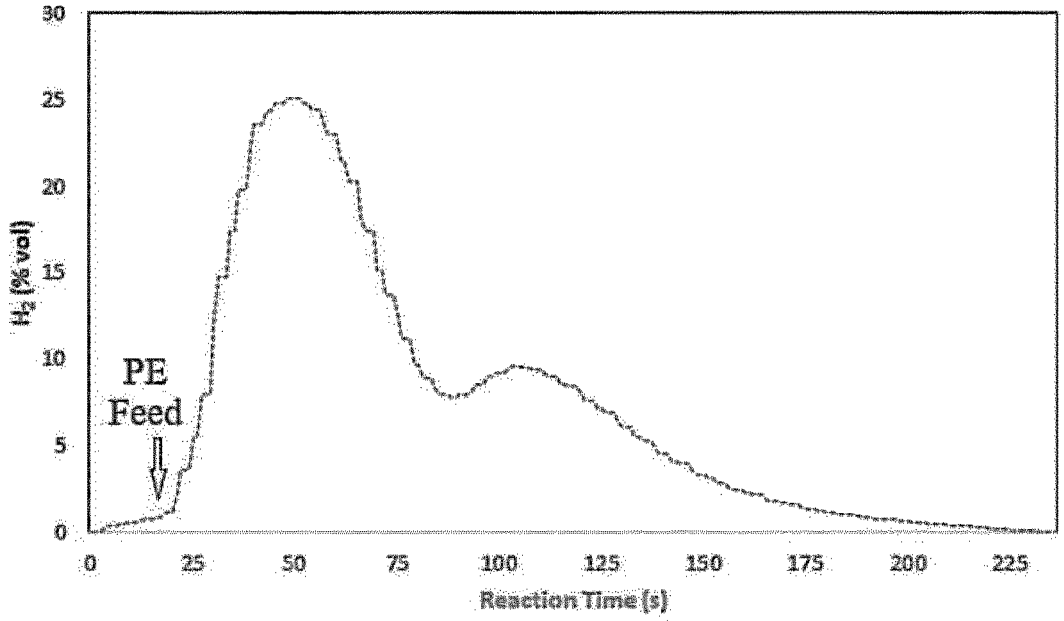
Figure 7: Concentration profile of hydrogen during oxidation or reduced bauxite in steam at 800 °C.

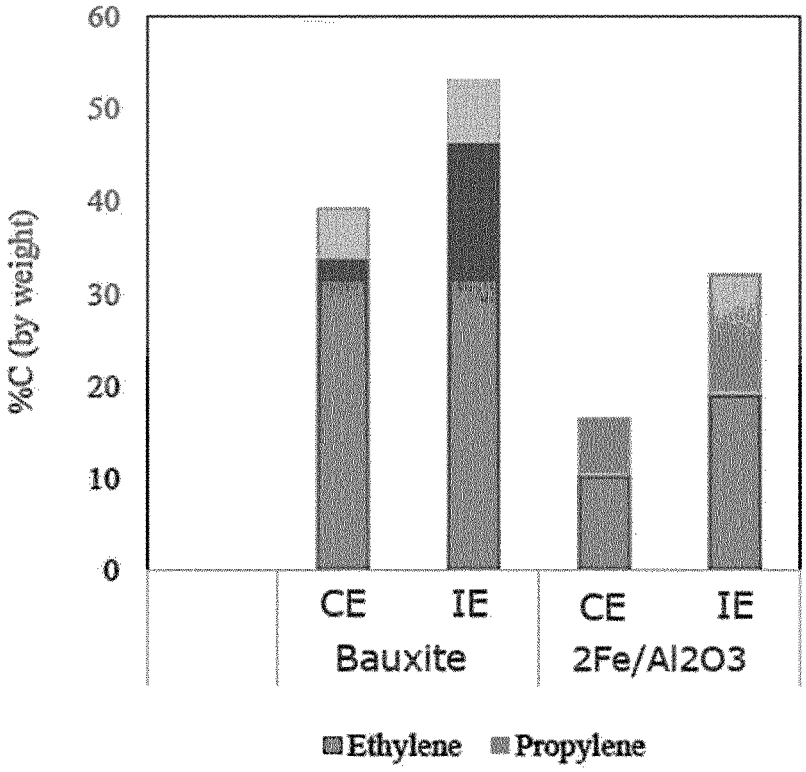
Figure 8: Yield of lighter olefins in comparison between the comparative (CE) and inventive (IE) examples.
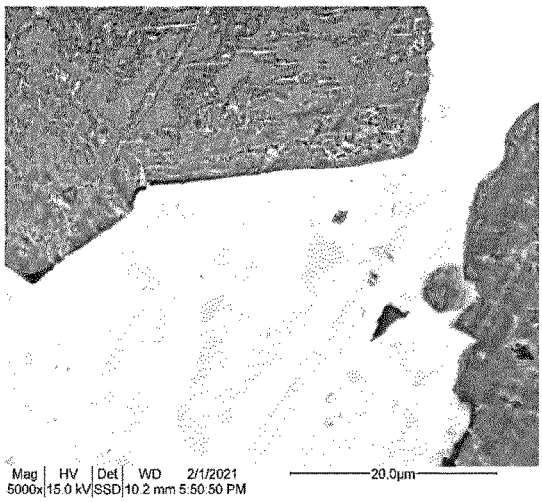
Figure 9: Back-scattered electron micrograph of $2Fe/Al_2O_3$ particles.

CONVERSION OF PLASTIC WASTE TO HYDROCARBONS USING A TRANSITION METAL OXIDE

CROSS REFERENCE TO RELATED APPLICATIONS

This is a 371 of PCT Application No. PCT/EP2022/081324 filed Nov. 9, 2022, which claims the benefit of European Application No. 21207982.6, filed Nov. 12, 2021, the contents of which are incorporated herein in their entirety.

FIELD OF THE INVENTION

The present invention relates to the field of the recycling of polymers, in particular the recycling of polymers to their monomeric parts. Even more particularly, the present invention relates to the recycling of polymers by steam cracking.

BACKGROUND

The cracking of plastic waste into chemical products utilising fluidised bed technology has been examined thoroughly since the 1970's as outlined e.g. in U.S. Pat. No. 3,985,820 A. Significant efforts have been directed towards producing oils and other heavier chemicals as a means of plastic waste disposal. However, these processes had the disadvantage that no direct access to the monomeric parts of a polymer is provided. However, having access to such technology is desired as it fully closes the cycle of polymer recycling.

Therefore, recent developments have also targeted monomer, in particular olefin, recovery from plastic waste with varying degrees of success. WO 2020/169888 A1 outlines a process, wherein plastic waste material is gasified in the presence of sand and Ca-containing species to produce hydrocarbons and specifically olefins. However, still a significant fraction of heavier compounds is formed besides the olefin fraction. The advantage of these processes is the absence of multifunctional catalysts which are very sensitive to various contaminants present in waste streams. However, generally, product distribution of such processes is controlled by the peak cracking temperature. Hence, these processes are purely thermally controlled. Moreover, higher selectivity towards monomeric parts in the output of the process is generally achieved using higher temperatures (i.e. higher severity), rendering the processes energetically unfavourable.

Hence, polymer cracking processes with catalytically active bed materials have been developed. Such catalytically active bed materials can interact with the pool of radicals in the reaction zone leading to an altered product distribution. Steam cracking of long chain saturated hydrocarbons proceeds through a free radical reaction mechanism. The initial hydrocarbon chain undergoes a random scission through breakage of the C—C bond forming two free radicals:

$$R—CH_2—CH_2—CH_2—CH_2—CH_2—CH_2—R \rightarrow R—CH_2—CH_2—CH_2^* + {}^*CH_2—CH_2—CH_2—R$$

In this first step, primary radicals are formed. Such primary radicals can undergo an intra-molecular H atom transfer (backbiting) yielding more stable secondary or tertiary radicals:

$$R—CH_2—CH_2—CH_2^* \rightarrow R—CH_2—C^*—CH_3$$

The initial distribution of hydrogen atoms along the carbon chain will, hence, be altered by the intramolecular H atom transfer. Further reaction of such radicals can lead to the formation of unstable free radicals with H/C≠2, such as methyl free radicals. These unstable free radicals can in turn abstract H atoms from surrounding molecules or free radicals. This is known as intermolecular H atom transfer. Intermolecular H atom transfer will further disturb the distribution of H atoms and might lead to abstraction of H atoms from stable molecules like ethylene:

$$CH_3^* + C_2H_4 \rightarrow CH_4 + C_2H_3^*$$

H atom transfer will lead to formation of products with varying H/C ratios, ranging from 0 to 4. The products derived from steam cracking of naphtha like hydrocarbons such as polyethylene can hence be divided into two groups:

1. H/C=2 (Same as that of initial polyethylene molecule)
2. H/C≠2 (Formed due to H atom transfer)

Products belonging to each of the categories are shown in Table 1.

TABLE 1

Products derived from steam cracking of naphtha like hydrocarbons

| H/C ratio = 2 | H/C ratio ≠ 2 |
|---|---|
| $C_2H_4$ | CO, $CO_2$, Coke |
| $C_3H_6$ | $CH_4$, $C_2H_6$, $C_3H_8$ |
| $C_4H_8$ | Benzene, Toluene, Styrene, Naphthalene, Anthracene, etc. |

In the absence of H atom transfers, the products of steam cracking are expected to have the same H/C ratio as that of the feed. Polymers like poly(methyl methacrylate) (PMMA) and polystyrene (PS) preserve their molecular structures as well as the H/C ratio upon steam cracking. Random scission in the PMMA or PS molecule leads to the formation of tertiary free radicals which are relatively more stable than the primary free radicals. Moreover, the presence of functional group —$COOCH_3$ and —$C_6H_5$ provides steric hindrance and hence avoids the abstraction of H atoms over the hydrocarbon chain.

Hence, H atoms transfer is important for steam cracking of polymer (e.g. polyolefin) hydrocarbons since it hinders the formation of lighter monomers (e.g. olefins: ethylene and propylene) and contributes to the formation of less valuable hydrocarbons (methane, carbons oxides, aromatics, etc.). This is in particular relevant, as H atom transfer during steam cracking of polyolefin cannot be avoided due to the absence of tertiary carbon atoms and the lack of steric hindrance along the polymer chain.

As a solution the prior art provides the hydrocracking process. During the hydrocracking process, the cracked hydrocarbon molecules are quickly hydrogenated under high hydrogen partial pressure. The catalyst used for such a process is a bifunctional catalyst with a cracking function and a hydrogenation function. The hydrogenation function work on the principle of activating the catalyst through adsorption of hydrogen under very high pressure (>200 bar).

Adsorption of H atoms on a surface of platinum (a hydrocracking catalyst) is illustrated in FIG. 1. Without the adsorption of hydrogen atoms under high pressure, the hydrogen molecule acts chemically inert due to its high bond dissociation energy (436 KJ/mol).

However, in comparison to the steam cracking processes as described above, the hydrocracking processes have the disadvantage of requiring very high pressures to work. Such high pressures result in the usual disadvantages of high energy consumption, high requirements on the equipment used and potential explosion risks.

OBJECT OF THE INVENTION

It is therefore an object of the present invention to find a process for steam cracking polymers, in particular polyolefins, wherein the steam cracking process has low energy requirements, high safety standards, and a high selectivity towards monomeric parts, in particular olefins, of the polymer. It is a further object of the present invention to provide such a steam cracking process, which can be carried out in a continuous manner.

SUMMARY OF THE INVENTION

It has now surprisingly found that above-mentioned object can be achieved by a process for producing a mixture of hydrocarbons from plastic waste, the process comprising the steps of a) contacting the plastic waste with steam and a hydrogen controlling material comprising at least one transition metal and/or its oxide, wherein the transition metal is not in its highest oxidation state, thereby forming a mixture of gaseous hydrocarbons and a mixture of condensed hydrocarbons, and oxidizing the hydrogen controlling material to an oxidized hydrogen controlling material; and x) withdrawing a mixture of hydrocarbons in gaseous form.

SHORT DESCRIPTION OF THE FIGURES

FIG. 1 is a schematic drawing of the hydrogen activation by hydrocracking catalysts.

FIG. 2 is a schematic drawing of the hydrogen activation by a transition metal from a water molecule.

FIG. 3 is a schematic drawing of the hydrogenation and recycling mechanism of the hydrogen controlling material according to the present invention.

FIG. 4 is a schematic drawing of the configuration of a typical dual fluidized bed (DFB) system.

FIG. 5 is a schematic drawing of the dual fluidized bed configuration of the present invention.

FIG. 6 is a schematic drawing of the reactor setup used in the comparative and inventive examples.

FIG. 7 is a concentration profile of hydrogen during oxidation of reduced bauxite in steam at 800° C.

FIG. 8 is a diagram showing the yield of lighter olefins in comparison between the comparative (CE) and inventive (IE) examples.

FIG. 9 is a back-scattered electron micrograph of 2Fe/$Al_2O_3$ particles.

DETAILED DESCRIPTION OF THE INVENTION

The present invention relates to a process, in which steam is contacted with plastic waste and a hydrogen controlling material comprising at least one transition metal and/or its oxide not being in its highest oxidation.

Thereby, the hydrogen controlling material helps to avoid intramolecular H atom transfer leading to the formation of secondary or tertiary free radicals and, hence, unwanted by-products besides the wanted monomeric parts of the polymer.

As hydrogen controlling material any transition metal and/or its oxide can be used as long as the transition metal is not in its highest oxidation state. In other words, the transition metal is in an oxidation state that can reduce $H_2O$ to $H_2$ at the given conditions. Preferably, the transition metal in the hydrogen controlling material is selected from the list consisting of Sc, Ti, V, Cr, Mn, Fe, Co, Ni, Cu and Zn. Generally, however, the selection of the hydrogen controlling material will depend on the minimum process temperature. For example, of all the transition metals Cr, Mn, Zn and Fe can be oxidized with steam (at least 1 bar pressure) at a temperature above 100° C., preferably in the range of 500 to 1200° C., more preferably in the range of 700 to 1000° C., and most preferably in the range of 700 to 900° C. Hence, more preferably, the transition metal of the hydrogen controlling material is selected from the list consisting of Cr, Mn, Zn and Fe. Most preferably, the transition metal of the hydrogen controlling material is Fe.

The hydrogen controlling material is preferably an oxide of the transition metal. Preferably, the transition metal has the second highest oxidation state. Most preferably, the transition metal has the lowest oxidation state.

In a specific embodiment, the hydrogen controlling material comprises a non-oxidized transition metal, such as iron in oxidation state 0.

In another specific embodiment, the hydrogen controlling material comprises a transition metal oxide, such as iron (II) oxide and/or iron (III) oxide, particularly iron (III) oxide. More particularly, the hydrogen controlling material comprises iron (III) oxide (i.e. $Fe_2O_3$).

In a further specific embodiment, the hydrogen controlling material is selected from reduced bauxite or $Al_2O_3$ particles (at least partially) coated with iron (III) oxide, preferably in an amount corresponding to 2 wt % atomic iron ("2Fe/$Al_2O_3$").

For the below explained reaction to work, it is in particular necessary that the hydrogen controlling material is in direct contact with the steam.

Without being bound to theory, it is believed that the transition metals not being in their highest oxidation state split the water molecules into hydrogen and oxygen:

$$Me + H_2O \rightarrow MeO + H_2$$

Since the water molecule reacts on the surface of the transition metal, the produced hydrogen on the metal surface can be compared to the adsorbed hydrogen on the hydrocracking catalyst (FIG. 1). Such splitting of a water molecule on the surface of a transition metal is illustrated in FIG. 2.

Hence, the hydrogen controlling material when used for steam cracking of hydrocarbons will hydrogenate the produced free radicals simultaneously to the cracking mechanism of the polymer chain. The H atoms required for hydrogenation are provided by the splitting of water molecules on the surface of such a hydrogen controlling material, while the oxygen atoms of the water molecules will oxidize the transition metal (for example, Me to MeO).

The oxidized hydrogen controlling material is then preferably recycled into the process after reducing it with a suitable reducing agent. Such a reducing agent is preferably selected from the list consisting of carbon monoxide, methane and hydrogen. Such a recycling process is depicted in FIG. 3.

The plastic waste generally can comprise a polymer backbone made up of an uninterrupted C—C chain. Hence, the plastic waste preferably comprises polymers such as polyolefins and halogenated polymers such as PVC, PTFE, etc. More preferably, the plastic waste comprises polyolefins, such as a polyolefin. The plastic waste may comprise one or more polyolefins selected from polyethylene homopolymers, polyethylene copolymers, polypropylene homopolymers and polypropylene copolymers. Most preferably, the plastic waste comprises polyethylene. The plastic waste is preferably substantially free of any additives such as fillers, antioxidants and generally additives.

The mixture of hydrocarbons preferably comprises monomers, which can be used to polymerize one of the polymers in the plastic waste. More preferably, the mixture of hydrocarbons comprises at least one of ethene, propene, or butene.

The temperature of step a) of the process of the present invention depends on the transition metal of the hydrogen controlling material used. Generally, the process of the present invention can usually be carried out at room temperature. Nevertheless, higher temperatures increase the reaction speed. Hence, preferably, the step a) of the process of the present invention is carried out at a temperature higher than 500° C. More preferably, the step a) of the process of the present invention is carried out at a temperature equal to or higher than 700° C. Typically, the step a) of the process of the present invention is carried out at a temperature not higher than 1000° C.

Preferably, the step a) of the process of the present invention is carried out at atmospheric or subatmospheric pressure. More preferably, the step a) of the process of the present invention is carried out at a pressure to allow the steam to be present in subcritical state at the temperature used in the process step a).

Preferably, the step a) of the process of the present invention is carried out as a fluidized bed step, wherein the steam forms part of a carrier gas and at least the hydrogen controlling material forms part of a fluidized bed material. It is essential for the present invention that the hydrogen controlling material is brought into contact with steam and the plastic waste. Hence, the hydrogen controlling material can be located anywhere in the bed material, but it has to be ensured that it is at least in parts in direct contact with steam and the plastic waste. Preferably, in such case, at least a part of the hydrogen controlling material is located at at least a part of the surface of the fluidized bed material. This is necessary to ensure that the steam and the plastic waste can get in contact with said hydrogen controlling material. Preferably, more than 50% of the surface of the fluidized bed material are covered by the hydrogen controlling material, more preferably more than 80% of the surface of the fluidized bed material are covered by the hydrogen controlling material. Preferably, the remaining parts of the fluidized bed material are chemically inert to the hydrogen activation reaction. More preferably, the remaining parts of the fluidized bed material are able to transfer heat. Even more preferably, the remaining parts of the fluidized bed material are metal oxides fulfilling the two before-mentioned properties. Hence, even more preferably, such metal oxides are selected from the list consisting of $SiO_2$, $Al_2O_3$, and MgO. Most preferably, the fluidized bed material is reduced bauxite.

In an embodiment, step a) of the process is carried out as a fluidized bed step wherein the fluidized bed material comprises particles of a metal oxide selected from $SiO_2$, $Al_2O_3$, and MgO, the particles being at least partially coated with the hydrogen controlling material.

In another embodiment, step a) of the process is carried out as a fluidized bed step wherein the fluidized bed material comprises particles of a metal oxide selected from $SiO_2$, $Al_2O_3$, and MgO, the particles being at least partially coated with at least one transition metal, wherein the transition metal is not in its highest oxidation state and wherein the transition metal is selected from the list consisting of Cr, Mn, Zn and Fe.

In another embodiment, step a) of the process is carried out as a fluidized bed step wherein the fluidized bed material comprises particles of a metal oxide selected from $SiO_2$, $Al_2O_3$, and MgO, the particles being at least partially coated with iron (III) oxide.

In a specific embodiment, step a) of the process is carried out as a fluidized bed step wherein the fluidized bed material comprises particles of $Al_2O_3$, the particles being at least partially coated with iron (III) oxide.

In another specific embodiment, step a) of the process is carried out as a fluidized bed step wherein the fluidized bed material comprises particles of reduced bauxite.

As mentioned above, the hydrogen controlling material needs to be reduced again after the cracking and hydrogenation reaction has taken place. Hence, to allow the process to be carried out in a continuous manner, the hydrogen controlling material needs also to be continuously reduced and reintroduced into step a). This can be done by any means the skilled person knows. A preferable way to achieve this goal is described in the following.

Preferably, the process of the invention, in which step a) is carried out as a fluidized bed step, is modified in that the fluidized bed material comprising the hydrogen controlling material is continuously or batchwise removed from the fluidized bed without disturbing the fluidizing step operation. This can be achieved by any means the skilled person is aware of. Preferably, this is achieved through non mechanical valves called loop seals (LS). Loop seals allow the transport of bed material between two reactors without exchange of any gasses. Usually, these loop seals are fluidized to avoid agglomeration of hot bed material. In a steam cracking process, the fluidization of the loop seals is usually done using steam.

The removed fluidized bed material contains a certain amount of oxidized hydrogen controlling material, as it has already been used to facilitate the steam cracking and hydrogenation reaction. Hence, after being removed from the fluidized bed, the steam used to fluidize the loop seals is at least partially replaced by a reducing agent, which reduces the oxidized hydrogen controlling material back to the hydrogen controlling material. Preferably, the reducing agent is selected from the list consisting of carbon monoxide, methane, and hydrogen. After the reducing step, the fluidized bed material comprising the hydrogen controlling material is reintroduced into the fluidized bed of step a).

Hence, the process of the present invention preferably further comprises the steps of b) withdrawing at least a part of the oxidized hydrogen controlling material from the fluidized bed of step a);

d) reducing the oxidized hydrogen controlling material using a reducing agent thereby forming said hydrogen controlling material;

e) reintroducing the hydrogen controlling material into step a).

Even more preferably, the reducing step of the oxidized hydrogen controlling material is combined with a heat providing step. A heat providing step is usually needed in industry to keep the heat in the steam cracking reactor high. The steam cracking reaction is an endothermic reaction having the need for continuously provided thermal energy. This can be provided by either heating up the reactor or by introducing hot material into the reactor. Such a configuration is defined as a dual fluidized bed (DFB) system. The most common industrial process that can be compared to such a DFB system is the fluid catalytic cracking (FCC) process. Hot fluidized bed material recirculates between two interconnected fluidized beds: a combustor and a steam cracker (FIG. 4). The overall reaction on the combustor side is exothermic whereas on the cracker side the reaction is endothermic. The heat generated on the combustor side is transported by the fluidized bed material to the cracker side to meet its endothermic heat demand. This type of configuration allows production of two separate gas streams: flue gas from the combustor and product gas from the cracker.

In a DFB system, a bed material is continuously circulated between two interconnected fluidized bed (FIG. 4). The bed material is completely oxidized in the combustor (in presence of air) and partially reduced in the cracker (in presence of hydrocarbon feed). Partially reduced bed material leaves the cracker along with unconverted solids and enters the combustor. Unconverted solids along with the bed material are oxidized in the combustor.

Also in a DFB system, the two fluidized beds are preferably interconnected through non mechanical valves called loop seals (LS). Loop seals allows the transport of bed material between two reactors without exchange of any gasses. Usually, these loop seals are fluidized to avoid agglomeration of hot bed material. Such a configuration is illustrated in FIG. 5. This system is modified according to the embodiment described beforehand, i.e. after being removed from the fluidized bed of the cracker, the steam used to fluidize the loop seal (LS2) is at least partially replaced by a reducing agent, which reduces the oxidized hydrogen controlling material back to the hydrogen controlling material. Preferably, the reducing agent is selected from the list consisting of carbon monoxide, methane, and hydrogen. After the reducing step, the hydrogen controlling material is reintroduced into the fluidized bed of step a).

Hence, even more preferably, the process of the present invention further comprises the steps of b) withdrawing at least a part of the oxidized hydrogen controlling material and at least a part of the mixture of condensed hydrocarbons from the fluidized bed of step a);

c) oxidizing the mixture of condensed hydrocarbons thereby forming a flue gas and a heated oxidized hydrogen controlling material;

d) reducing the heated oxidized hydrogen controlling material using a reducing agent thereby forming said hydrogen controlling material;

e) reintroducing the hydrogen controlling material into step a).

Preferably, step c) of the process of the present invention is carried out at a temperature of 500 to 1200° C., preferably of 700 to 1000° C., most preferably 800 to 900° C. Likewise, preferably, step c) of the process of the present invention is carried out at below atmospheric pressure, preferably a pressure above −0.5 bar (g), preferably in the range of −0.8 to −2 kPa.

Also preferably, step d) of the process of the present invention is carried out at a temperature of 500 to 1200° C., preferably of 700 to 1000° C., most preferably 800 to 900° C. Likewise, preferably, step d) of the process of the present invention is carried out at below atmospheric pressure, preferably a pressure above −0.5 bar (g), preferably in the range of −0.8 to −2 kPa.

Preferably, the transfer of the hydrogen controlling material in the process of the preferred embodiment is performed by transfer of the fluidized bed material comprising the hydrogen controlling material.

Examples

Measurement Methods

Bed Material Analysis

To confirm the presence of Fe in $Al_2O_3$ particles, SEM-EDS was conducted. FIG. 9 shows the back-scattered electron (BSE) signal from a cross-section of $Al_2O_3$ particles coated iron (III) oxide where the wt. % of atomic iron is 2% based on the total weight of the coated $Al_2O_3$ particles. The contrast of BSE was generated by differences in average atomic weight i.e., the brightness of the pixels increases with the increase in the atomic weight of the scanned element. Therefore, the epoxy consisting of light elements appears in black and the particles in brighter shades. As Fe is heavier than Al, the relative Fe content of the particles can be determined from BSE contrast, where the brighter particles contain relatively more Fe.

Devolatization Gas Analysis

The sampled gas is analysed for its $H_2$, CO, $CO_2$ and $CH_4$ concentration (% vol) by a SICK GMS 820 permanent gas analyser. These gases are monitored continuously to determine the total time of devolatization and to make sure that no volatile gases are left after the sampling time of 120 s.

Comprehensive Gas Analysis

For a comprehensive analysis of other devolatilized species, the remaining part of the sampled gas is passed through a coil condenser, maintained at −5° C. Gases leaving the coil condenser are collected in a 0.5 l Tedlar gas bag. The gas bags collected during each experiment are analysed with an Agilent 490 Micro GC system to measure the composition. The Agilent micro-GC is equipped with four different columns with a TCD detector for each column. A summary of gases measured by the micro-GC system is shown in Table 2.

TABLE 2

Conditions of micro GC system

| Column | Gases | Calibration |
|---|---|---|
| CP-Cox | He, $H_2$, Air, CO, $CH_4$ | 4-point calibration with standard calibration gas bottles |
| PoraPLOT U | $CO_2$, $C_2H_4$, $C_2H_6$, $C_2H_2$, $C_3H_6$, $C_3H_8$ | 4-point calibration with standard calibration gas bottles |
| CP-WAX 52 CB | Benzene, toluene | No calibration |
| CP-Sil 5 CB | $C_4H_x$, $C_5H_x$ | 1-point calibration with non-calibration gas bottle |

Materials

The PE pellets used in this work, with bulk density of 945 kg/m$^3$ and 2.5 mm pellet size are provided by Borealis AB.

Bed materials with different amounts of iron oxide are investigated for their hydrogenation capability. Chemical composition of the bed materials used in this work are detailed in Table 3 (wt % based on the total weight of the material).

TABLE 3

Composition of used materials

| Type | Bauxite Natural Ore | $Al_2O_3$ Synthetic | $2Fe/Al_2O_3$ Synthetic |
|---|---|---|---|
| $Al_2O_3$ | 78 wt. % | 99.9 wt. % | 94.5 wt. % |
| $SiO_2$ | 15 wt. % | <0.01 wt. % | <0.01 wt. % |
| $FeO + Fe_2O_3 + Fe_3O_4$ | 1.3 wt. % | <0.01 wt. % | 5.50 wt. % |
| MgO | 0.2 wt. % | <0.01 wt. % | <0.01 wt. % |
| CaO | 0.6 wt. % | <0.01 wt. % | <0.01 wt. % |
| $TiO_2$ | 4.9 wt % | — | — |
| Avg. particle size | 0.235 mm | 0.2 mm | 0.2 mm |

Bauxite is directly obtained from its natural ore whereas $Al_2O_3$ is synthetic material obtained from Sigma Aldrich. $2Fe/Al_2O_3$ is prepared by impregnating the $Al_2O_3$ with iron nitrate nonahydrate ($Fe(NO_3)_3 \cdot 9\ H_2O$) solution through incipient wetness impregnation. $Fe_2O_3$ is formed on the surface of $Al_2O_3$ according to the following reaction:

$$Fe(NO_3) \cdot 9H_2O \rightarrow \text{(heat)}\ Fe_2O_3 + 3NO_2 + 9H_2O$$

The $2Fe/Al_2O_3$ material is calcined at 700° C. Thus, it may be assumed that most of the iron (Fe) is in the form of $Fe_2O_3$ and thus in oxidation state +3, i.e. Fe(III). Hence, "$2Fe/Al_2O_3$" is defined herein as $Al_2O_3$ coated with iron (III) oxide wherein the wt. % of atomic iron is 2% based on the total weight of the coated $Al_2O_3$ particles.

Reactor Setup

The experimental setup used for the comparative and the inventive examples is shown in FIG. 6. The main reactor is a stainless-steel tube of 88.9 mm in internal diameter (ID) and 1305 mm in height. It is a bubbling fluidized bed reactor, which resembles the cracker of a DFB system Fluidization gases are fed from the bottom of the reactor via a windbox and a distributor plate. The fluidization gases are fed separately and mixed homogeneously in the windbox before entering the reactor through the gas distributor plate. The flow of the fluidization gases is controlled by a mass flow controller (MFC).

The reactor is heated externally with an electric oven. Temperature along the height of the reactor is measured and logged continuously by the thermocouples on the back side of the reactor. Bed material is loaded from the top of the reactor before turning on the reactor oven. A split stream of the gases leaving the reactor is sampled through one of the gas sampling port: h1 to h5.

A gas sampling probe is inserted into the reactor through one of the ports while the rest of the ports are sealed to avoid bed material entering the port. The height of the port is selected depending on the height of the fluidized bed. The probe is heated up to 350° C. with electrical heating band to avoid condensation of hydrocarbons and steam. The sampled gas is then split into two parts, one part is passed through a gas conditioning system and the other is passed through a coil condenser.

The gas conditioning system involves scrubbing of the sampled gas with isopropanol followed by drying with silica gel beads and glass wool. As shown in FIG. 6, the gas conditioning system is immersed in a water bath. The cold and dry gas is then analysed by a SICK GMS 820 permanent gas analyser. The coil condenser used in this work is a 4.5 m long PTFE tube coil, maintained at −5° C. Gas sampled through the coil condenser is collected in a 0.5 l Tedlar gas bag.

Comparative Examples

PE pellets weighing 1 g per batch are dropped directly on the top of the hot fluidized bed. The experimental conditions and the procedure for each set of experiment are summarized in Table 4 and Table 5, respectively.

During devolatization and char combustion stages of each experiment, helium is used as one of fluidization gases. A known volume of helium is used a tracer gas to determine the volume of gases produces during devolatization and char combustion.

Before dropping each batch of PE pellets, the bed material is subjected to an oxidizing environment at the same reaction temperature. Oxidation of bed material is achieved by fluidizing the bed material with air, as mentioned in the previous section.

A slipstream of gases leaving the reactor is sampled through the sampling port h5 and continuously analysed for its $O_2$ concentration (% vol). Complete oxidation is assumed when the $O_2$ concentration leaving the fluidized bed matches the ambient $O_2$ concentration of 20.9% vol. Bed materials are fully oxidized before each batch of experiments so as to simulate the conditions of a DFB system, where the bed material enters the cracker after being fully oxidized in the combustor.

The condition used in the comparative examples are shown in tables 4 and 5.

TABLE 4

Reaction conditions for comparative and inventive examples

| | Bauxite | $2Fe/Al_2O3$ |
|---|---|---|
| Temperature [° C.] | 800 | 700 |
| Repetitions | 2 | 5 |
| $W_{BATCH}$ (g) | 1.0 | 2.0 |

TABLE 5

Fluidization gas flows during comparative examples

| Experimental stage | Fluidization gases $N_2$ [l/m] | Steam [l/min] | Air [l/min] | He [l/min] | Time |
|---|---|---|---|---|---|
| Oxidation | 0.00 | 0.00 | 5.00 | 0.00 | Until $O_2$ conc. of 20.9%* |
| Devolatization | 2.00 | 5.80 | 0.00 | 0.05 | 120 s |
| Char combustion | 0.00 | 0.00 | 5.00 | 0.00 | 120 s |
| Oxidation | 0.00 | 0.00 | 5.00 | 0.00 | Until $O_2$ conc. of 20.9%* |

*here "%" refers to "vol % of the fluidization gas"

During steam cracking of polyethylene, one part of the sampled gas is analysed for its $H_2$, CO, $CO_2$ and $CH_4$ concentration (% vol) by the continuous gas analyser. These gases are monitored continuously to determine the total time of devolatization and to make sure that no volatile gases are left after the sampling time of 120 s.

To analyse the full spectrum of products in the created output gas, micro-GC was undertaken.

Inventive Examples

Concurrent hydrogenation of hydrocarbon species produced from steam cracking of polyethlyene is achieved through splitting of water molecules on the surface of the bed material containing reduced transition metals. The bed material is fluidized with a mixture of CO and $N_2$ in order to reduce the iron oxides present in the bed material. The bed material is fluidized with $CO/N_2$ mixture until the concentration of $CO_2$ exiting the reactor reaches 0% vol. Iron oxide content of the bed materials are reduced according to the following equation:

$$Fe_2O_3 + CO \rightarrow \text{(heat)}\ 2FeO + CO_2$$

The fluidization gases are then switched to 100% $N_2$ for 2 min in order to purge the reactor and create an inert environment. Steam is added to the fluidized bed as a fluidization gas after the concentration of CO reaches 0%. Steam added to the reactor will be converted into hydrogen by the bed material according to the following reaction:

$$2FeO + H_2O \rightarrow Fe_2O_3 + H_2$$

The polyethylene pellets are dropped directly on the top of the fluidized bed, immediately after steam is added to the reactor. This ensures that the steam cracking and hydrogen generation reactions occur simultaneously. The concentration profile of the produced hydrogen during the process with bauxite as bed material is shown in FIG. 7. In FIG. 7 the reaction time indicated as "PE Feed" is the time at which the polyethylene pellets are fed on the top of the fluidized bed. The experimental procedure is described in Tables 4 and 6.

TABLE 6

Fluidization gas flows during inventive examples

| Experimental stage | Fluidization gases $N_2$ [l/m] | Steam [l/min] | Air [l/min] | CO [l/min] | He [l/min] | Time |
|---|---|---|---|---|---|---|
| Oxidation | 0.00 | 0.00 | 5.00 | 0.00 | 0.00 | Until $O_2$ conc. of 20.9%* |
| Reduction | 2.00 | 0.00 | 0.00 | 3.00 | 0.00 | Until $CO_2$ conc. of 0.0%* |
| Inert | 2.00 | 0.00 | 0.00 | 0.00 | 0.00 | Until CO conc. of 0.0%* |
| Steam cracking | 2.00 | 5.80 | 0.00 | 0.00 | 0.05 | 120 s |
| Char combustion | 0.00 | 0.00 | 5.00 | 0.00 | 0.05 | 120 s |

*here "%" refers to "vol % of the fluidization gas"

Results

The yields of the gaseous products obtained for the comparative and the inventive examples for steam cracking of polyethylene in presence of bauxite and $2Fe/Al_2O_3$ are shown in Table 7.

TABLE 7

Gaseous products produced in comparative and inventive examples

| | Bauxite | | $2Fe/Al_2O_3$ | |
|---|---|---|---|---|
| | CE | IE | CE | IE |
| % C (by weight) | | | | |
| Ethylene | 33.77 | 46.33 | 10.22 | 19.05 |
| Propylene | 5.54 | 6.85 | 6.34 | 13.09 |
| Methane | 14.83 | 18.3 | 5.7 | 11.39 |
| Ethane | 3.24 | 3.79 | 2.66 | 5.97 |
| $CO_x$ | 12.48 | 12.78 | 8.66 | 8.42 |
| % H (by weight) | | | | |
| Hydrogen | 7.38 | 13.84 | 10.07 | 9.21 |

The yield of lighter olefins, ethylene and propylene increases significantly when using a transition metal not being at the highest oxidation state, i.e. being reduced. A comparison between the yields of lighter olefins from both hydrogen controlling materials is shown in FIG. 8. From the results it is clear that the hydrogen produced by splitting of water molecules on the surface of reduced transition metals interferes with the free radical pool produced during the steam cracking of polyethylene. As the present examples have been performed at normal pressure, it could be shown that high selectivity towards lighter monomeric parts of the polymer in steam cracking processes is possible at low pressures.

Furthermore, in bauxite, $Fe_2O_3$ is not located solely at the surface of the $Al_2O_3$ particles but is homogeneously spread as individual particles throughout the $Al_2O_3$ material. Contrarily, in $2Fe/Al_2O_3$, the $Al_2O_3$ have $Fe_2O_3$ layers at their surface. FIG. 9 shows a scanning electron microscope (SEM) image of $2Fe/Al_2O_3$. Hydrogen donation works well for both bed materials. However, for $2Fe/Al_2O_3$ the difference in olefin yield is significantly higher.

The invention claimed is:

1. A process for producing a mixture of hydrocarbons from plastic waste, the process comprising the steps of:

a) contacting the plastic waste with steam and a hydrogen controlling material comprising at least one transition metal and/or its oxide, wherein the transition metal is not in its highest oxidation state, thereby forming a mixture of gaseous hydrocarbons and a mixture of condensed hydrocarbons, and oxidizing the hydrogen controlling material to an oxidized hydrogen controlling material;

x) withdrawing a mixture of hydrocarbons in gaseous form.

2. The process according to claim 1, wherein the transition metal is selected from the group consisting of Cr, Mn, Zn and Fe.

3. The process according to claim 1, wherein the hydrogen controlling material comprises iron (II) oxide and/or iron (III) oxide.

4. The process according to claim 1, wherein the hydrogen controlling material is selected from reduced bauxite or $Al_2O_3$ particles coated with iron (III) oxide.

5. The process according to claim 1, wherein the plastic waste comprises one or more polyolefins.

6. The process according to claim 5, wherein the polyolefin is selected from a polyethylene homopolymer, a polyethylene copolymer, a polypropylene homopolymer, or a polypropylene copolymer.

7. The process according to claim 1, wherein step a) is carried out at a temperature of more than 500° C.

8. The process according to claim 1, wherein step a) is carried out at a normal pressure.

9. The process according to claim 1, wherein step a) is carried out as a fluidized bed step, wherein the steam forms part of a carrier gas and at least the hydrogen controlling material forms part of a fluidized bed.

10. The process according to claim 8, the process further comprising the steps of b) withdrawing at least a part of the oxidized hydrogen controlling material and at least a part of the mixture of condensed hydrocarbons from the fluidized bed of step a);

c) oxidizing the mixture of condensed hydrocarbons thereby forming a flue gas and a heated oxidized hydrogen controlling material;

d) reducing the heated oxidized hydrogen controlling material using a reducing agent thereby forming said hydrogen controlling material;

e) reintroducing the hydrogen controlling material into step a).

11. The process according to claim 9, wherein the reducing agent is selected from the list consisting of carbon monoxide, methane, and hydrogen.

12. The process according to claim 8 wherein step c) is carried out at a temperature of 500 to 1200° C.

13. The process according to claim 8, wherein step c) is carried out at below atmospheric pressure.

14. The process according to claim 8, wherein step d) is carried out at a temperature of 500 to 1200° C.

15. The process according to claim 8, wherein step d) is carried out at below atmospheric pressure.

16. The process according to claim 8, wherein step c) is carried out as a fluidized bed step.

17. The process according to claim 4, wherein the $Al_2O_3$ particles coated with iron (III) oxide are coated in an amount corresponding to 2 wt % atomic iron ("$2Fe/Al_2O_3$").

18. The process according to claim 1, wherein the hydrogen controlling material is iron in oxidation state 0.

19. The process according to claim 1, wherein step a) is carried out at a temperature of 700° C. to 1000° C.

* * * * *